United States Patent [19]

Springer

[11] 4,411,512

[45] Oct. 25, 1983

[54] MAGNETIC TONER TRANSFER APPARATUS

[75] Inventor: Gilbert D. Springer, Sunnyvale, Calif.

[73] Assignee: Ferix Corporation, Sunnyvale, Calif.

[21] Appl. No.: 381,924

[22] Filed: May 26, 1982

[51] Int. Cl.[3] ..... G03G 15/00; G03G 15/16

[52] U.S. Cl. ..... 355/3 TR; 355/14 TR; 355/3 TE; 118/657; 118/658

[58] Field of Search ..... 355/3 TR, 14 D, 14 TR, 355/14 SH, 3 TE, 3 CH; 361/221, 225; 118/657, 658; 101/91, 92, 113, DIG. 13; 430/199, 39

[56] References Cited

U.S. PATENT DOCUMENTS

| | | | |
|---|---|---|---|
| 3,370,546 | 2/1968 | Muller | 101/91 |
| 4,048,957 | 9/1977 | Tagawa | 118/658 X |
| 4,067,296 | 1/1978 | Sessink | 118/658 |
| 4,190,348 | 2/1980 | Friday | 355/3 TR |
| 4,266,328 | 5/1981 | Harada et al. | 355/3 DD X |
| 4,318,606 | 3/1982 | Buholtz et al. | 118/657 X |
| 4,379,630 | 4/1983 | Suzuki | 355/14 TR X |

*Primary Examiner*—A. C. Prescott

*Attorney, Agent, or Firm*—Kolisch, Hartwell & Dickinson

[57] ABSTRACT

Apparatus for transferring toner magnetically adhering to magnetic images stored in a magnet image-storage medium to a toner-adherable receiving medium such as paper. Included is a platen which presses the paper against the storage medium to form regions of contact and noncontact between the paper and storage medium. A boundary between the two regions is defined by a line of contact. The apparatus also includes magnets for producing a magnetic field in the paper and storage medium which is asymetrical with respect to the line of contact. The field is stronger in the region of noncontact than in the region of contact. In the preferred embodiment, the field originates from a pair of spaced-apart, confronting magnetic poles disposed on a side of the paper opposite from the storage medium. The apparatus is structured to produce selectively a field in the storage medium having a magnetizing force less than or, alternatively, greater than, the coercivity of the storage medium.

17 Claims, 4 Drawing Figures

MAGNETIC TONER TRANSFER APPARATUS

BACKGROUND AND SUMMARY OF THE INVENTION

This invention pertains to apparatus for transferring magnetically attractable toner from a magnetic image-storage medium to a toner-receiving medium. More specifically, it pertains to such an apparatus structured to apply, in combination, pressure and a magnetic field during toner transfer.

As indicated, this invention is primarily intended for use in a toner transfer system of the type having a conventional magnetic image-storage medium having a magnetizable facial expanse which is typically disposed on a rotatable drum surface. Facial expanse, containing magnetic images produced by a writing head, is transported past a counter-rotating toner-applicator cylinder having a layer of toner disposed thereon. The magnetic images attract the toner creating, thereby, toner images which it is desired to dispose on a separate toner-adherable receiving medium, such as paper. The paper is transported along a path adjacent the facial expanse for transferring the toner to the paper. Finally, the toner is fused to the paper.

Several different methods have been used to transfer toner from a drum to paper. A common method is to use a high-pressure platen to press the paper against the toner-holding facial expanse. Such a method is also sometimes used in combination with heat in order to increase the fusing of the toner onto the paper. Such processes have inherent disadvantages in that, due to the bending and distortion of the paper, the resulting image is distorted. It is also difficult to realign paper after it enters such a high-pressure nip region. Additionally, undesired toner residue often remains on the facial expanse.

Another method sometimes used is to transfer toner by magnetic tractive force as the paper is transported close to, yet spaced apart from, the drum facial expanse. The magnetic force is provided by disposing a magnetic pole of one polarity inside the drum and one of an opposite polarity on the opposite side of the paper from the drum. The outside pole adjacent the paper is placed nearer to the facial expanse than is the pole contained within the drum. The toner, being attracted to the outside pole, transfers to the paper.

Alternatively, a pair of opposite poles of a magnet have been known to be used adjacent the side of the paper opposite from the drum. The faces of such poles are disposed approximately normally to each other to create a generally rounded field in the area of desired toner transfer.

Such purely magnetic field transfer methods tend to cause blurred images and stray toner deposits due to inconsistent paths traveled in the space between the surfaces by the toner.

It is, therefore, a general object of the present invention to provide a toner transfer apparatus which overcomes the above-mentioned problems of the prior art.

More specifically, it is an object to provide a toner transfer apparatus which uses a combination of pressure and a well-defined magnetic field produced in an adjacent region of noncontact between the paper and the facial expanse.

It is further desired to provide an apparatus which provides a convenient method of D.C. erasing the facial expanse. This includes an apparatus which will condition the magnetic domains within the facial expanse prior to its being encoded with new images. Alternatively, where it is desired to repeat a given image, it is an object to provide an apparatus which transfers toner without altering the magnetic domains of the facial expanse.

An apparatus constructed as contemplated by the present invention includes a platen which presses the paper against the facial expanse of the drum as the two travel in adjacent commonly directed paths. This produces a region in which the paper and facial expanse are in contact and an adjacent region in which they are not in contact. A line of contact defines the boundary between the two regions.

Also included is at lease one magnet for producing a magnetic field which extends through the paper and facial expanse. Its stronger portion exists in the region of noncontact. Such a field is selectively energized to have two different operating states. In one state the magnetic force is less than the coercivity of the facial expanse. In the other, it exceeds that coercivity. In this latter state, the images stored in the facial expanse of the magnetic image-storage medium are erased prior to encoading the expanse with new images.

Thus, by sequentially applying a moderate pressure and a magnetic field, clear toner images are transfered.

These and additional objects and advantages of the present invention will be more clearly understood from a consideration of the drawings and the following detailed description of the preferred embodiments.

DETAILED DESCRIPTION OF THE INVENTION

Figure 1:
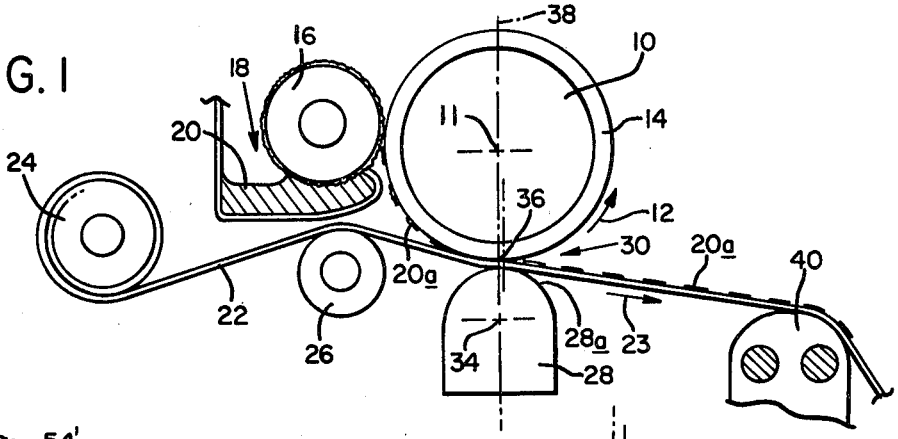
FIG. 1 is a side, schematic view of a toner transfer system having an apparatus made in conformance with this invention.

Referring initially to FIG. 1 and explaining the general arrangement of components in a toner transfer system of the type usable with the present invention, a cylindrical drum 10 is rotatable in a counterclockwise direction about an axis 11 as shown by arrow 12 in the figure. On the curved surface of drum 10 is a magnetic image storage medium 14 which receives and stores magnetic images produced by a conventional writing head, not shown. A cylindrical toner applicator wheel 16, having a length corresponding to that of drum 10, rotates through a toner reservoir, shown generally at 18, which contains a supply of magnetically attractable toner 20. Toner 20 is magnetically attracted to the circumference of wheel 16. The wheel is disposed adjacent drum 10 and also rotates in a counterclockwise direction. Some of the toner is atttracted from wheel 16 to the magnetic images stored in medium 14 where it forms toner images, such as image 20*a*.

A supply of suitable toner-adherable receiving medium, such as paper 22, is stored in a supply roll 24. Paper 22 is then transported along a path in the direction of arrow 23 past suitable guides, such as guide pin 26, then adjacent the radially distant side of drum 10, as shown. The surfaces of drum 10 and paper 22 preferably travel at essentially the same speed and in the same direction in the area of adjacency. Paper 22 is pressed against drum 10 by a transfer apparatus 28 having an upper curved surface 28*a*. Transfer of toner images 20*a* from medium 14 to the contacting paper surface occurs in a toner transfer zone shown generally at 30.

In the embodiment shown, apparatus 28 has a semicylindrical upper surface 28*a* which is convex relative to paper 22 and drum 10. Surface 28*a* has a central axis of curvature 34 which is parallel to drum axis 11. Therefore, the pressing of paper 22 against drum 10 produces a line of contact 36 between the surface of medium 14 and paper 22. Line 36 exists at the intersection of medium 14 with a plane containing both axes 11 and 34, which plane is shown as dash-dot line 38 in the figures. Paper 22 separates from the surface of drum 10 at the line of contact. After paper 22 passes drum 10, it is directed adjacent a fuser 40 which, typically through a heat process, fuses the toner images to the paper.

Figure 4:
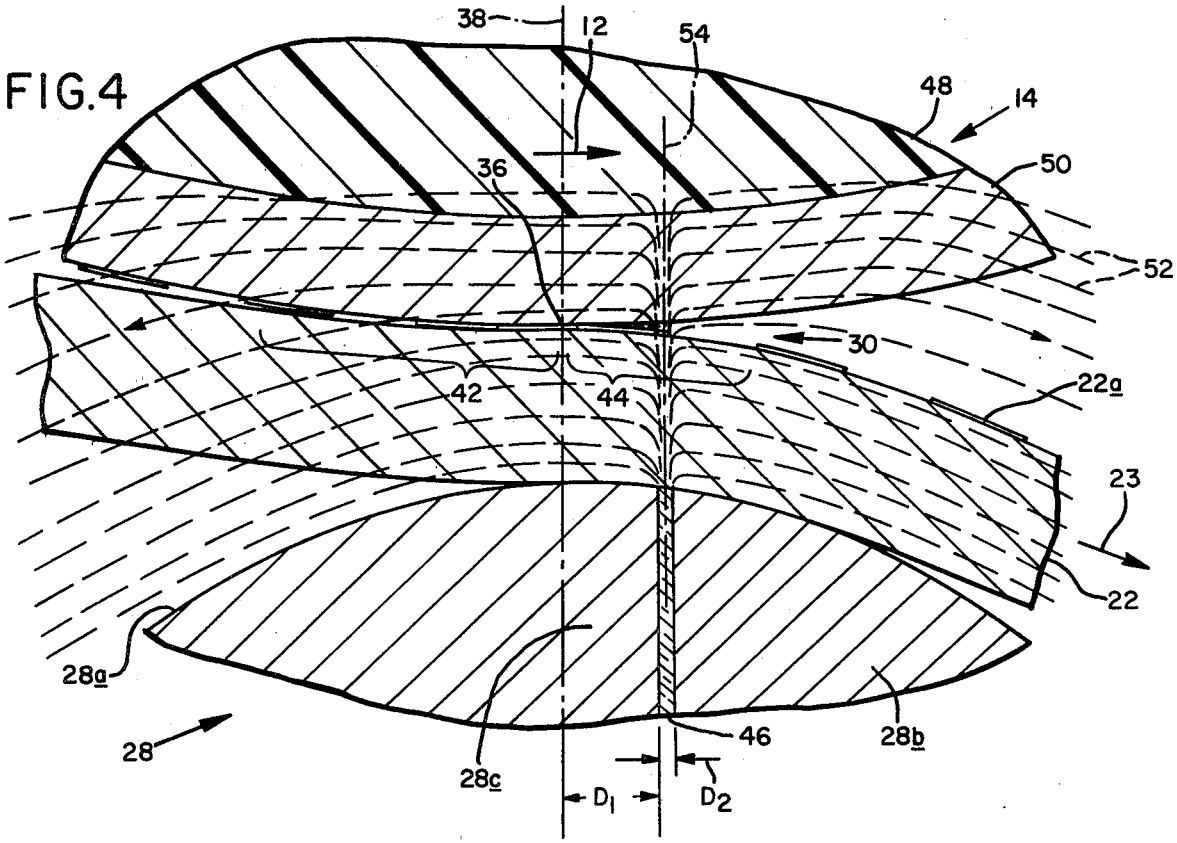
FIG. 4 is a further enlarged fragmentary cross-sectional view, not drawn to scale, of the portion of FIG. 1 adjacent the zone of toner transfer using the apparatus of FIG. 3.

FIG. 4 is a substantially enlarged view of the area of FIG. 1 surrounding transfer zone 30 in which paper 22 is pressed against image storage medium 14 of drum 10 by apparatus 28. Medium 14 is of conventional magnetic webbing construction and includes a flexible plastic backing 48 and a film-like magnetizable facial expanse 50. As viewed in the figure, it can be seen that in the region designated as 42 immediately to the left of plane 38, paper 22 is in contact with expanse 50. In a region 44, downstream from line 36, the paper and medium 14 are not in contact.

Apparatus 28 is actually constructed to perform two functions in the preferred embodiment. As has been discussed previously, upper surface 28*a* acts essentially as a platen to apply pressure along plane 38 against paper 22 and medium 14 of drum 10. However, in addition to its functioning as a means for pressing the paper against medium 14, it also functions as a means for producing a magnetic field in toner transfer zone 30. This field is asymetrical with respect to line of contact 36 in that the stronger portion of the field exists in region of noncontact 44. Such a field is producible by the existence of spaced-apart, confronting magnetic poles in apparatus 28 adjacent the region of noncontact. Referring to FIG. 4, a non-magnetic spacer 46, which functions as a magnetic gap, is formed of a non-magnetic material, such as glass. It extends in a sheet-like configuration which is generally parallel with plane 38 but spaced downstream therefrom, as shown.

The two portions of apparatus 28 adjacent the right and left surfaces of spacer 46, identified, respectively, as 28*b*, 28*c*, are magnetic poles. Poles 28*b*, 28*c* may be either poles of like or opposite polarity. FIG. 4 was drawn to approximate scale for poles of like polarity, either both north or both south poles. In either instance, it has been found that, for paper having a thickness of approximately two or three mils, a drum having a radius of approximately four inches and a radius of curvature of surface 28*a* of approximately two inches, the face of pole 28*c* is preferably a distance $D_1$ of approximately one mil from plane 38. The thickness of spacer 46, identified as distance $D_2$, is approximately 0.1 mil for poles of like polarity and approximately one mil for poles of opposite polarity.

Assuming poles 28*b*, 28*c* are of like polarity, magnetic flux lines, represented as dashed-lines 52, eminate from the poles, and diverge sharply away from a plane of symmetry shown as dash-dot line 54. Thus, a fairly strong magnetic field extends through paper 22 and expanse 50 adjacent plane 54. By making spacer 46 relatively narrow for poles of like polarity, it is possible, with a pair of comparatively low strength magnets, to obtain a thin concentrated magnetic field of a desired strength.

Figure 3:
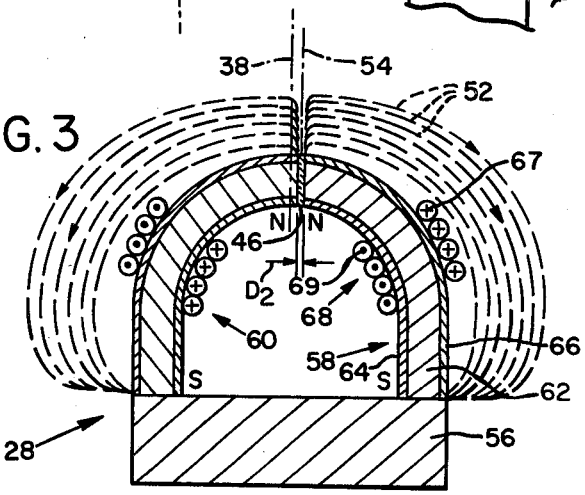
FIG. 3 is also an elongate side cross-sectional view of a transfer apparatus except that it is constructed with poles of the same polarity.

The overall construction of a transfer apparatus 28 constructed with poles of like polarity is shown in FIG. 3. The letters "S" and "N" designate south and north poles, respectively. This apparatus includes a non-magnetic base 56 which is fixedly attached to a supporting structure, not shown, in a manner to produce the desired pressure against paper 22 and drum 10. Extending above the outer right and left margins of base 56 are magnets 58, 60, respectively. Both magnets extend upwardly, toward each other and terminate as spaced-apart, confronting poles, as shown and discussed previously with reference to FIG. 4. Magnets 58, 60 are mirror images of each other relative to plane 54. Therefore, discussion will be limited to describing magnet 58 and it will be understood that similar comments will apply for magnet 60.

Magnet 58 is operable to selectively produce a magnetic field in region of noncontact 44 which, jointly with magnet 60, produces a magnetic field which is, in one state, less than, and in a second state, greater than the coercivity of facial expanse 50. If gamma ferric oxide having a coercivity of 300 oersteds is used, magnetic field strengths of approximately 200 oersteds and 1000 oersteds have been found effective. The lower strength magnetic field provides effective toner transfer without altering the magnetic images stored in expanse 50. This is important when it is desired to make multiple copies of the images. The stronger magnetic field is used to erase the magnetic images in the expanse and uniformly align the magnetic domains therein for subsequently encoding new magnetic images.

In the embodiment shown in FIG. 3, the magnetic field of a lesser strength is provided by permanent magnets, such as by inner core 62 which is typically made of an iron-nickel alloy. Permanently magnetizable materials typically have a low permeability which requires a relatively large amount of energy to increase the field to the stronger level. Therefore, core 62 has disposed along its inner and outer surface areas, films 64, 66, respectively, which are made of a highly permeable material, such as silicon iron. An electromagnetic coil 68 is disposed around films 64, 66. The stronger magnetic field is thereby obtained by electromagnetizing the films with relatively lower electrical exciting energy than would be required for core 62.

The direction of current flow shown in coil 68 produces a north pole adjacent spacer 46. This is obtained by driving current in the conductors of coil 68 as shown. The plus symbol 67 represents current directed away from the viewer of FIG. 3 and the dot symbol 69 represents current directed toward the viewer.

Figure 2:
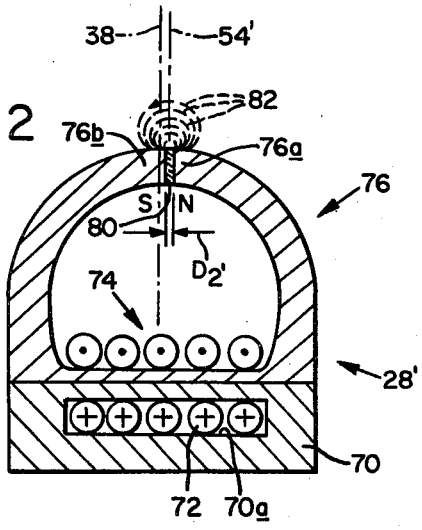
FIG. 2 is an elongate side cross-sectional view of the transfer apparatus of FIG. 1 constructed with magnetic poles of opposite polarity.

Referring now to FIG. 2, a second preferred embodiment of transfer apparatus 28 is shown generally as 28'. It includes a non-magnetic base 70 having a generally rectangular outer cross-section as shown, which extends the length of drum 10. A channel 70*a* extends longitudinally in base 70 as shown and is sized for receipt of a plurality of electrical conductors, such as conductor 72, which combine to form an electromagnetic coil, shown generally at 74. Coil 74 drives a single magnet 76 which is disposed above base 70 and is generally D-shaped in cross-section with the back of the D lying horizontally on the top of base 70 within coil 74, as shown. A magnet having the north and south polarities shown is produced by current flowing as shown by the same plus and dot symbol convention described with referenge to FIG. 3.

The curved upper portion of magnet 76 is magnetically discontinuous to the extent that a non-magnetic spacer 80, equivalent to spacer 46 in FIGS. 3 and 4, is disposed therein. The geometry of the structure of this upper region conforms to that illustrated and described with reference to FIG. 4 with the understanding that spacer thickness $D_2'$ has the previously mentioned value of approximately one mil. The poles 76*a*, 76*b* of magnet 76 are disposed respectively adjacent the right and left, generally planar, surfaces of spacer 80. Magnet 76 is made of a highly permeable material and provides a continuous magnetic circuit except for the gap produced by spacer 80. Because of the low permeability of spacer 80, a leakage magnetic field represented by flux lines 82 exists above the spacer. This field is generally symetrical about plane 54'. It is therefore asymetrical with respect to plane 38. The stronger region of the field—which is most particularly strong vertically along plane 54'—exists in the region of noncontact, as has been discussed with reference to FIG. 4.

Magnet 76 is energizable to produce the two previously mentioned magnetic field strengths by varying tapping locations on the coil or by varying the exciting current in the coil.

Reviewing operation of the toner transfer system, paper 22 is directed from supply roll 24, over guide pin 26 to transfer zone 30 between drum 10 and apparatus 28. The timing of this paper transport is coordinated with the rotation of drum 10 past toner transfer wheel 16. Apparatus 28 presses paper 22 against facial expanse 50 and toner images 20*a* contained thereon. As the paper and facial expanse separate, apparatus 28 subjects the toner images to a magnetic tractive force which completes transfer of the toner images to the paper.

There are several forces influencing the transfer of toner to paper as it travels through transfer zone 30. There is an inherent adhesion between toner and paper under the influence of pressure which is generally greater than the adhesion between toner and expanse 50. With the geometry of the structure as shown in the figures, the gravitational force acting on the toner is directed toward the paper and away from the expanse. Additionally, the angular momentum applied on the toner by the rotational motion of the drum assists in the transfer of toner. Finally, and most importantly, the tractive force on the toner due to the magnetic field produced by transfer apparatus 28 is substantially greater than the tractive force due to the field produced by the magnetic image stored in expanse 50. By spacing the magnetic gap, or spacer as it has been termed, downstream from the plane of contact, the most intense magnetic field is applied where paper 22 first separates from expanse 50.

As has been mentioned, in operation, there are times when it is desired to make several copies of the magnetic images stored in expanse 50. In these cases it is important that the strength of the magnetic field produced by apparatus 28 in expanse 50 be less than the coercivity of the expanse in order to avoid altering the magnetic images stored therein. This lower field strength may be produced by either a permanent magnet or by an electromagnet. By controlling the magnitude of the field, the effective range of the field is controlled, since the field strength is inversely proportional to the square of the distance from the source of the flux.

Correspondingly, the strength of the field is increased to a value which alters the magnetic domains of the facial expanse in order to erase the images stored therein. When a field strength greater than the coercivity of facial expanse 50 is applied, the magnetic domains are reoriented and a DC magnetic bias is created in the expanse. This DC bias provides a magnetc field of a specific direction on the expanse. A magnetic flux of an opposite nature, as provided by writing heads, cause discontinuities in domain alignment which are capable of capturing toner. In these instances, the magnetic field provides a duel function of transferring toner to the paper as well as conditioning the expanse to facilitate the formation of new magnetic images therein.

While the invention has been particularly shown and described with reference to the foregoing preferred embodiment, it will be understood by those skilled in the art that other changes in form and detail may be made therein without departing from the spirit and scope of the invention as defined in the following claims. For instance, although the surfaces of drum 10 and apparatus 28 are circular and convex with respect to each other in cross-section as seen in FIGS. 1 and 4, any appropriate surfaces may be substituted which produce the desired line of contact and corresponding regions of noncontact and contact. Also, the region of noncontact may be disposed upstream from the region of contact.

It is claimed and desired to secure by Letters Patent:

1. In a toner transfer system of the type useable with a magnetic image-storage medium having a magnetizable facial expanse transportable along a first known path, a magnetically attractable toner and a toner-adherable receiving medium transportable along a second known path, a portion of which is adjacent said first path, apparatus for transferring toner adhering to a magnetic image stored in such an expanse to such a receiving medium comprising means for pressing the receiving medium against the expanse in the region where such paths are adjacent and establishing thereby at least one line of contact which defines a boundary between a region of contact and a region of noncontact between the receiving medium and the expanse, and means for producing a magnetic field in the expanse and receiving medium, which field originates from at least one magnetic pole disposed on an opposite side of such a receiving medium relative to such an expanse, in such a manner whereby the field is asymetrical with respect to said line of contact, and the stronger portion of the field exists in the region of noncontact.

2. The device of claim 1, wherein the expanse has a known coercivity, and wherein said magnetic field-producing means is structured to be operable selectively in two different operating states, in one of which said field-producing means creates a field in the expanse which has a magnetizing force less than the above-mentioned coercivity, and in the other of which it creates a field in the expanse which has a magnetizing force greater than the same coercivity.

3. The device of claim 1, wherein said field-producing means further includes another magnetic pole magnetically spaced from said one pole, and the faces of said poles are disposed adjacent said region of noncontact.

4. The device of claim 3, wherein said poles are of opposite polarity.

5. The device of claim 3, wherein said poles are of like polarity.

6. The device of claim 1, wherein said region of noncontact is on the downstream side of said line of contact.

7. In a toner transfer system, having a toner transfer zone, of the type useable with a magnetic image-storage medium having a magnetizable facial expanse transportable through such zone along a first known path, a magnetically attractable toner and a toner-adherable receiving medium transportable through such zone along a second known path, a portion of which is adjacent the first path, apparatus for transferring toner adhering to a magnetic image stored in such an expanse to such a receiving medium comprising means for pressing the receiving medium against the expanse disposed in such zone in the region where such paths are adjacent and establishing thereby at least one line of contact which defines a boundary between a region of contact and a region of noncontact between the receiving medium and the expanse, and means for producing a magnetic field in such zone in the expanse and receiving medium, which field originates from at least one magnetic pole disposed adjacent such zone on an opposite side of such a receiving medium relative to such an expanse in a manner whereby the field is asymetrical with respect to said line of contact, and the stronger portion of the field exists in the region of noncontact.

8. The device of claim 7, wherein the expanse has a known coercivity, and wherein said magnetic field-producing means is structured to be operable selectively in two different operating states, in one of which said field-producing means creates a field in the expanse which has a magnetizing force less than the above-mentioned coercivity, and in the other of which it creates a field in the expanse which has a magnetizing force greater than the same coercivity.

9. The device of claim 7, wherein said field-producing means further includes another magnetic pole magnetically spaced from said one pole, and the faces of said poles are disposed adjacent said region of noncontact.

10. The device of claim 9, wherein said poles are of opposite polarity.

11. The device of claim 9, wherein said poles are of like polarity.

12. The device of claim 7, wherein said region of non-contact is on the downstream side of said line of contact.

13. In a toner transfer system, having a toner transfer zone, of the type useable with a magnetic image-storage medium having a magnetizable facial expanse transportable through such zone along an annular first known path of a known radius, a magnetically attractable toner, and a toner-adherable receiving medium transportable through such zone along a second known path, a portion of which is adjacent a radially distant side of the first path, apparatus for transferring toner adhering to a magnetic image stored in such an expanse to such a receiving medium comprising means for pressing the receiving medium against the expanse in such zone in the region where such paths are adjacent, said means having a surface which is convex relative to such receiving medium, and establishing thereby at least one line of contact which defines a boundary between a region of contact and a region of non-contact between the receiving medium and the expanse, and means for producing a magnetic field in such zone in the expanse and receiving medium, including a pair of confronting magnetically spaced-apart magnetic poles operatively disposed adjacent the noncontact region of such zone on the opposite side of such a receiving medium relative to such an expanse, in a manner whereby the field is asymetrical with respect to said line of contact, and the stronger portion of the field exists in the region of noncontact.

14. The device of claim 13, wherein the expanse has a known coercivity, and wherein said magnetic field-producing means is structrued to be operable selectively in two different operating states, in one of which said field-producing means creates a field in the expanse which has a magnetizing force less than the above-mentioned coercivity, and in the other of which it creates a field in the expanse which has a magnetizing force greater than the same coercivity.

15. The device of claim 13, wherein said poles are of opposite polarity.

16. The device of claim 13, wherein said poles are of like polarity.

17. The device of claim 13, wherein said region of noncontact is on the downstream side of said line of contact.

* * * * *